United States Patent [19]

Marzocchi

[11] 4,319,854

[45] Mar. 16, 1982

[54] MOISTURE CONTROL METHOD AND MEANS FOR PAVEMENTS AND BRIDGE DECK CONSTRUCTIONS

[75] Inventor: Alfred Marzocchi, Newark, Ohio

[73] Assignee: Owens-Corning Fiberglas Corporation, Toledo, Ohio

[21] Appl. No.: 861,489

[22] Filed: Dec. 19, 1977

[51] Int. Cl.[3] ..... E01C 3/00

[52] U.S. Cl. ..... 404/28; 404/70

[58] Field of Search ..... 404/28, 31, 27, 72, 404/17, 70, 71, 18

[56] References Cited

U.S. PATENT DOCUMENTS

| | | | |
|---|---|---|---|
| B 418,490 | 1/1975 | Condo | 404/31 |
| 1,507,282 | 9/1924 | Hammatt | 404/28 |
| 2,078,485 | 4/1937 | Dunham | 404/31 |
| 2,115,667 | 4/1938 | Ellis | 404/70 |
| 2,139,816 | 12/1938 | Fordyce | 404/70 |
| 2,184,811 | 12/1939 | Freer | 404/17 X |
| 2,353,027 | 7/1944 | Goodwin | 404/28 |
| 2,951,004 | 8/1960 | Martin | 404/72 X |
| 3,047,701 | 7/1962 | Frungel | 404/17 X |
| 3,279,334 | 10/1966 | Quartararo | 404/31 |
| 3,626,149 | 12/1971 | Carney | 404/31 |

FOREIGN PATENT DOCUMENTS

| | | | |
|---|---|---|---|
| 375745 | 4/1964 | Switzerland | 404/70 |

*Primary Examiner*—Nile C. Byers, Jr.

*Attorney, Agent, or Firm*—Ronald C. Hudgens; Greg Dziegielewski; Harry O. Ernsberger

[57] ABSTRACT

The disclosure embraces a method, system and means for controlling or conveying away liquids or moisture that may permeate or penetrate asphalt-surfaced roadways, pavements, bridge deck constructions and the like and includes a membrane or membrane construction functioning as a moisture or liquid barrier or control means disposed between a roadway, pavement or bridge deck wear surface layer and a concrete substrate for retarding, resisting or preventing deterioration of roadways, pavements, bridge deck constructions and the like.

11 Claims, 5 Drawing Figures

MOISTURE CONTROL METHOD AND MEANS FOR PAVEMENTS AND BRIDGE DECK CONSTRUCTIONS

The present invention relates to a roadway, pavement, bridge deck construction and the like which include an asphalt aggregate wear surface layer and a substrate or base of concrete and more particularly to a method, system and means associated with the wear surface and the substrate for controlling flow of liquid or moisture, the invention involving more particularly a control means, such as a membrane or membrane construction, for controlling moisture or directing or conveying liquids away from the roadway, pavement or bridge deck construction to reduce or substantially eliminate deterioration of a roadway, pavement or bridge deck construction which may be caused by moisture or liquids.

In certain road or pavement constructions and bridge deck constructions it is conventional practice to provide a base or substrate of concrete with an overlayer of asphalt aggregate forming a wear surface. The concrete base of bridge deck constructions and certain types of pavement is reinforced with steel bars known as rebars and in bridge deck constructions the concrete base or substrate is supported by metal structural members. Liquids or moisture tend to descend through the asphalt into the concrete substrate and cause corrosion and deterioration of the rebars or metal supporting members.

The salting of the pavement or bridge deck surface to melt ice or snow results in a saline or salt water which accelerates corrosion and deterioration of the metal rebars and bridge deck supporting members, a condition which impairs the stability of the construction and necessitates frequent repairs and costly maintenance.

The invention has for an object the provision of a method or system for controlling moisture or liquids which may penetrate or permeate an asphalt surface of a roadway, pavement, bridge deck or the like through the use of a membrane or membrane construction to impede penetration or permeation of moisture or liquids to the concrete substrate or base or for conveying away moisture or liquids to retard or resist deterioration of the roadway, pavement or bridge deck.

Another object of the invention resides in the provision of a membrane or membrane construction comprising one or more layers of glass fibers particularly in the form of scrim disposed under the asphalt wear course for directing moisture or liquid, such as water, laterally away from the roadway, pavement or bridge deck construction to prevent or reduce penetration or permeation of the liquid or moisture into the concrete substrate and to prevent moisture that may be in the concrete substrate from migrating upwardly to the asphalt wear surface.

Another object of the invention resides in the provision in a roadway, pavement or bridge deck construction of a membrane or membrane construction providing a moisture and liquid resistant barrier adhesively bonding a concrete substrate or the like to an overcourse or wear layer of asphalt or asphaltic material, the membrane or membrane construction being of a character to resist disassociation of the same from the roadway, pavement or bridge deck substrate.

A further object of the invention embraces the incorporation in a road, pavement or bridge deck construction of a membrane or membrane construction between an asphalt wear course and a concrete substrate embodying an electrically-conducting means or mat connected with a source of electric energy providing cathodic protection against corrosion and deterioration of metal rods in a concrete reinforced substrate particularly for use with reinforced concrete bridge decking, the electrically-conducting means or mat drawing chloride ions away from the steel reinforcing bars and thereby reducing the tendency of the bars to corrode.

Further objects and advantages are within the scope of this invention such as relate to the arrangement, method of operation and function of the related elements, to various details of construction and to combinations of parts, elements per se, and to economies of manufacture and numerous other features as will be apparent from a consideration of the specification and drawing of a form of the invention, which may be preferred, in which.

Figure 4:
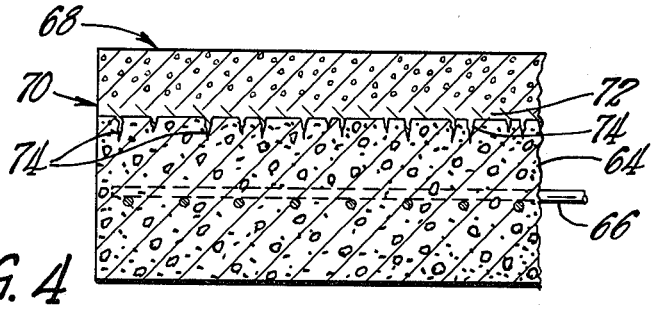
Figure 5:
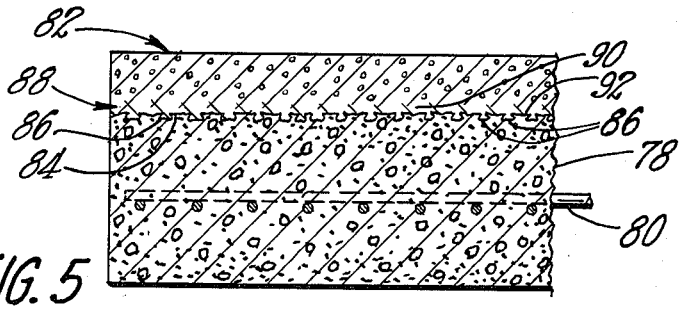

FIG. 4 is a schematic fragmentary sectional view of a pavement or bridge deck construction embodying a moisture barrier or membrane construction bonding an asphalt wear surface layer to a concrete substrate, and FIG. 5 is a schematic fragmentary sectional view similar to FIG. 4 illustrating a modified arrangement of bonding an asphalt wear surface layer to the upper surface of a concrete base or substrate of a bridge deck or pavement construction.

Figure 1:
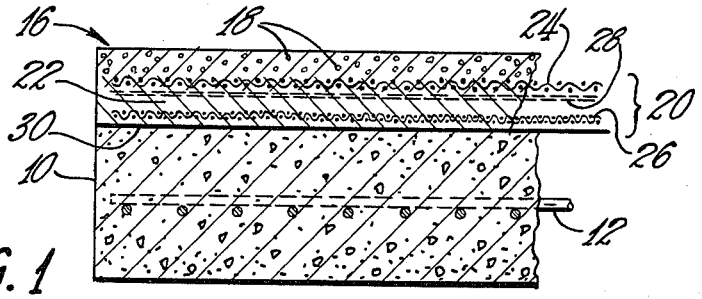
FIG. 1 is a schematic fragmentary sectional view of a concrete pavement or bridge deck having an asphalt wear course illustrating a form of the invention associated therewith.

Referring to the drawings in detail and initially to FIG. 1, there is illustrated a substrate or base 10 of concrete which may be a bridge deck or the substrate layer of a pavement or the like. The concrete substrate 10 where used as a bridge deck may be supported by metal structural members of conventional character. The concrete substrate 10 may be reinforced with rebars 12 (steel reinforcing bars) particularly if the substrate is utilized as a bridge deck.

Overlying the substrate 10 is a wear course 16 of bituminous or similar material such as asphalt, asphaltic material, or asphalt and aggregate which may contain sand, stone, screened gravel, crushed stone 18 or the like.

Disposed between the wear course 16 and the concrete substrate 10 is a membrane or membrane construction 20 functioning as a moisture or liquid controlling medium. In the embodiment illustrated in FIG. 1, the membrane 20 is inclusive of a body or layer of asphalt 22 or like material. Embedded in or disposed at the upper region of the asphalt 22 is a layer, mat or body 24 of scrim fabric of glass fibers or filaments of conventional construction.

Embedded in or disposed at the lower region of the asphalt 22 is a second layer, mat or body 26 of scrim fabric of glass fibers or filaments of conventional construction. If desired, glass flake 28 may be mixed in the asphalt preferably between the layers 24 and 26 of glass scrim. The membrane construction 20 is securely adhered to the upper surface of the substrate 10 by means of a tack cost 30 of adhesive such as an asphalt elastomeric composition, for example, emulsified asphalt which will wet out the concrete substrate surface effectively and become mechanically bonded to the surface.

The upper layer 24 of scrim is preferably of comparatively coarse mesh and the scrim is fashioned of yarns, each composed of several strands of glass fibers or filaments. The diameter of each yarn of the scrim may be in a range of one-eighth of an inch in diameter to about three-eighths of an inch in diameter and the filaments or fibers of the strands making up the yarns may be continuous or discontinuous fibers.

The fibers or filaments of such yarns may be of diameters of about ten hundred thousandths of an inch to one hundred thousandths of an inch or more. The mesh of the scrim fabric should preferably be in a range between one-quarter of an inch and one-half of an inch. The lower layer 26 of scrim fabric is preferably of closer or finer mesh than the mesh of the upper layer 24 of scrim fabric.

The upper layer 24 of scrim is preferably of more open or larger mesh so that fluid, such as salt water, tends to flow or be conveyed laterally by the scrim layer 24 and away from the asphalt. The lower layer of finer mesh scrim provides a drainage component since the areas of liquid origin, such as salt water, would occur in more specific places in the membrane and thus the fine scrim forms a more effective barrier against the passage of moisture or liquid downwardly through the underlying concrete substrate.

The upper layer 24 of glass scrim being of more open mesh than that of the lower layer 26 of glass scrim allows liquid or moisture flow therethrough and then laterally out therefrom over the surface of the sandwiched asphalt 22. One or both of the scrim fabrics may be treated or impregnated with a hydrophobic material, such as stearate chromyl chloride or stearate silanes. This treatment of the fibers of the lower layer 26 of scrim fabric tends to prevent a wicking or migrating of the water by capillary action from the concrete substrate back under the membrane. The lower layer 26 of scrim fabric is particularly effective in removing water which may migrate up through the concrete of the bridge deck.

If desired, glass flake 28 may be embedded in the asphalt 22 to render the membrane construction 20 more impermeable to water or other liquids and further to act as a barrier against the passage of water or other liquids to the concrete substrate.

The membrane or membrane construction 20 provides an effective control of liquids or moisture to substantially prevent moisture, water, salt water, or other fluids on the wear surface 16 from filtering downwardly into the concrete substrate 10 and for preventing moisture in the concrete substrate 10 from reaching the wear surface 16. The membrane construction is effective in controlling moisture or liquids and minimizes or prevents damage to the substrate by reason of oxidation, water freezing and thawing cycles and other conditions adversely effecting or contributing to the deterioration of asphalt and concrete bridge deck or pavement construction.

Figure 2:
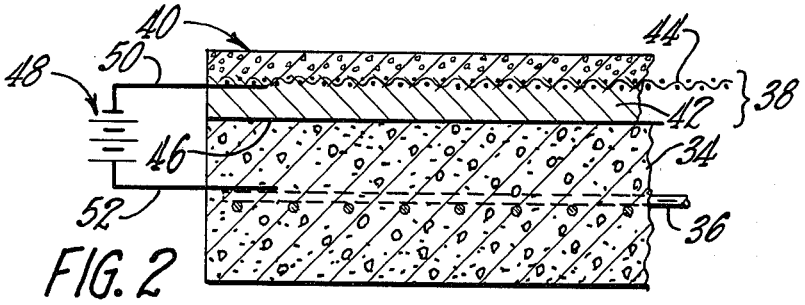
FIG. 2 is a schematic fragmentary sectional view of a form of the invention associated with an asphalt-surfaced concrete pavement or bridge deck reinforced with metal bars illustrating a method and electric current-conducting means providing a cathodic control against corrosion.

FIG. 2 illustrates a means or method providing cathodic protection against deterioration of metal members or components of bridge decking particularly where the bridge decking is supported by structural steel members. Referring to FIG. 2, there is illustrated a substrate, body or deck 34 of concrete of a bridge or pavement construction. Where the substrate 34 is a deck of a bridge roadway it may be supported upon structural steel members (not shown) in a conventional manner.

The concrete substrate 34 preferably includes metal or steel reinforcing bars or rebars 36 which are conventional in bridge deck construction. Disposed upon the concrete substrate 34 is a moisture controlling membrane or membrane construction 38 upon which is superposed a wear surface 40 which may be of asphalt or asphalt and aggregate construction similar to the wear surface 16 shown in FIG. 1.

The membrane 38 is inclusive of an asphalt layer or body 42 which is securely adhered to the upper surface of the substrate by a tack coat 46 of adhesive such as emulsified asphalt or other suitable material. In the upper surface region of the asphalt layer 42 is embedded or disposed an electrically-conductive means, body or mat 44 of glass fibers or other suitable material, the body or mat being impregnated with or bearing an electrically-conductive material such as graphite or the like.

A source of electrical potential such as a battery 48 is connected by a conducting means or current conductor 50 with the electrically-conducting body or mat 44, and a second conducting means or conductor 52 connects the battery 48 with the steel reinforcing bars or rebars 36 or structural support members (not shown) of a bridge deck.

In event a saline solution (salt water) filters or migrates through the membrane construction 38 and into the concrete substrate 34, a circuit is completed through the membrane 38 and the substrate 34 to the rebars or the metal structural support members, and chloride ions are drawn by electric current flow toward the electrically-conducting means, mat or body 44 and away from the rebars 36 and other metal support members.

Through this arrangement the tendency for the rebars or metal support members to corrode or oxidize is reduced or substantially eliminated. The arrangement may be effectively used for drawing away or dissociating ions from various salts such as sodium chloride, calcium chloride and the like or other compounds which may be ionized. The asphalt component 42 of the membrane construction 38 is porous and is in adhesive contact with the upper surface of the concrete deck 34 and tends to bleed off gases that may be formed.

Figure 3:
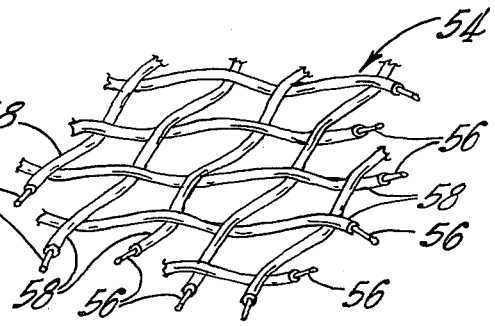
FIG. 3 illustrates a fragmentary perspective view showing a modified current-conducting means for securing cathodic control for a pavement or bridge deck construction.

FIG. 3 illustrates another form of electrically-conductive body or mat 54 which may be used as an alternative form for the body or mat 44 shown in FIG. 2. The electrically-conductive body 54 comprises a woven mat of metal wires 56 as electric current conductors, each of the wires being encased by a glass coating 58. The glass coating on each of the wires should be comparatively thin to minimize the resistance to current flow to the metal wires or conductors 56.

In the use of the current conducting body or mat 54, the battery, such as the battery illustrated at 48 in FIG. 2, is connected to the wires or conductors 56 and to the rebars or metal reinforcing bars and/or the metal supports for the concrete deck or substrate such as that illustrated at 34 in FIG. 2.

By reason of the resistance of the coating 58 of glass on the wires 56, the voltage of the battery establishing the potential may be comparatively high as, for example, two hundred volts or more to effect current flow through the glass coating on the wires 56 sufficient to draw the chloride ions away from the metal rebars or the metal support structure for the deck to effectively reduce the tendency of the rebars or deck supporting structure to corrode or oxidize. With the arrangement shown in FIG. 3 the chloride ions, drawn away from the rebars or deck supporting structure, could not collect upon the metal wires 56.

FIG. 4 illustrates an arrangement wherein a membrane or membrane construction providing a moisture or liquid barrier is adhesively or mechanically bonded to the surface of a concrete bridge deck or other substrate. In FIG. 4 the concrete deck or substrate 64 may be provided with steel reinforcing bars or rebars 66 as in the arrangement shown in FIGS. 1 and 2. An overcourse or wear surface layer 68 of asphalt and aggregate may be of the same general character as the asphalt and aggregate layers shown at 16 and 40 in FIGS. 1 and 2.

Disposed between the concrete substrate 64 and the wear course or layer 68 is a membrane or membrane construction 70 which includes a layer or body of asphalt 72. An emulsified asphalt, wax or other suitable adhesive material 74 as a component of the membrane or membrane construction joins the asphalt 72 of the membrane construction to the concrete substrate 64.

As illustrated, the bonding adhesive 74 penetrates into interstices or pores in the upper surface area of the concrete substrate 64 to provide a bonding zone from the surface and a distance below the surface of the bridge deck to securely bond the membrane or membrane construction 70 to the concrete substrate 64. The "roots" of the adhesive layer penetrating into the pores in the concrete substrate 64 provide a strong bond preventing disassociation of the moisture resistance barrier 70 from the concrete substrate 64 of a bridge deck or other substrate.

FIG. 5 illustrates a modification of the arrangement shown in FIG. 4 providing a moisture and liquid resistant barrier adhesively or mechanically bonded to the surface of a concrete bridge deck or other substrate. In FIG. 5 the concrete deck or decking 78 may be provided with steel reinforcing bars or rebars 80. An overcoarse or wear surface 82 of asphalt and aggregate may be of the same character as the overcoarse or wear surface 68 shown in FIG. 4.

The upper surface of the concrete substrate 78 is provided with a roughened, serrated, or saw-toothed upper surface 84 providing indentations 86 in the substrate surface. Disposed between the asphalt wear surface layer 82 and the surface 84 of the substrate 78 is a membrane or membrane construction 88.

The membrane or membrane construction 88 includes a layer or body of asphalt 90 and a suitable adhesive 92, such as emulsified asphalt or wax, which joins the asphalt layer 90 of the membrane or membrane construction to the roughened surface 84 of the concrete substrate 78. The roughened, serrated, or saw-toothed upper surface of the substrate resists relative movement of the membrane and wear surface relative to the substrate.

If desired, the upper surface of the substrate 78 may have undercut indentations to resist movement of the membrane or membrane structure vertically away from the bridge deck or substrate. In the form shown in FIGS. 4 and 5, a large amount of aggregate may be concentrated at the upper region of the bridge deck or substrate to promote soaking or penetration of the adhesive into the substrate.

The membrane or membrane structures hereinbefore described provide an effective moisture and liquid resistance barrier between the wear surface and the substrate or bridge deck construction. The membrane or membrane construction prevents moisture and liquid from the wear surface penetrating into the concrete substrate as well as to prevent seepage or migration of moisture from the substrate moving upwardly to the wear surface.

It is apparent that, within the scope of the invention, modifications and different arrangements may be made other than as herein disclosed, and the present disclosure is illustrative merely, the invention comprehending all variations thereof.

I claim:

1. A pavement construction including an upper wear course of asphaltic material and an underlying substrate, a moisture-controlling membrane disposed between the wear course and the substrate, said membrane comprising a layer of asphalt, an adhesive bonding the layer of asphalt to the substrate, a first layer of glass fibers in engaging relation with the layer of asphalt, the first layer of glass fibers being embedded in an upper region of the layer of asphalt, a second layer of glass fibers embedded in a lower region of the layer of asphalt, the layers of glass fibers being of glass fiber scrim, the upper layer of glass fiber scrim being of more open mesh than that of the lower layer of glass fiber scrim.

2. A pavement construction according to claim 1 wherein the lower layer of glass fiber scrim is treated with a hydrophobic material.

3. A pavement construction according to claim 1 wherein the upper layer of glass fiber scrim is treated with a hydrophobic material.

4. A moisture-controlling membrane construction for disposition between a wear course of asphaltic material and a substrate of a pavement comprising a layer of asphalt, a first layer of scrim material in an upper region of the layer of asphalt, a second layer of scrim material below the first layer of scrim material and in engagement with the layer of asphalt, the lower layer of scrim material being of finer mesh than that of the upper layer of scrim material, and an adhesive for bonding the layer of asphalt to the upper surface of the substrate.

5. A moisture-controlling membrane construction according to claim 4 wherein glass flake is embedded in the layer of asphalt.

6. A pavement construction including a wear course and an underlying substrate of concrete embodying metal reinforcing members, a moisture-controlling membrane construction disposed between the wear course and the substrate, the membrane construction comprising a layer of asphalt, a body of electrically conducting material associated with the layer of asphalt, and a source of electric energy connected with the body of current conducting material and the metal members whereby to draw chloride ions of salt water which may filter into the substrate away from the metal reinforcing members.

7. A pavement construction according to claim 6 wherein the pavement is a bridge deck.

8. A moisture-controlling membrane construction for disposition between a wear course of asphaltic material and a concrete substrate of a pavement wherein the substrate embodies metal reinforcing members comprising a layer of asphalt, a body of electrically conducting material associated with the layer of asphalt, an adhesive bonding the layer of asphalt to the substrate, and a source of electric energy connected with the body of current conducting material and the metal members whereby to draw chloride ions of salt water which may filter into the substrate away from the metal reinforcing members.

9. A moisture-controlling membrane construction for disposition between a wear course and a concrete substrate of a pavement wherein the substrate embodies metal reinforcing members comprising a layer of asphalt, a body of electrically conducting material comprising a scrim fabric impregnated with graphite associated with the layer of asphalt, an adhesive bonding the layer of asphalt to the substrate, and a source of electric energy connected with the body of current conducting material and the metal members whereby to draw chloride ions of salt water which may filter into the substrate away from the metal reinforcing members.

10. A moisture-controlling membrane construction for disposition between a wear course and a concrete substrate of a pavement wherein the substrate embodies metal reinforcing members comprising a layer of asphalt, a body of electrically conducting material comprising a mat of glass fibers impregnated with graphite associated with the layer of asphalt, an adhesive bonding the layer of asphalt to the substrate, and a source of electric energy connected with the body of current conducting material and the metal members whereby to draw chloride ions of salt water which may filter into the substrate away from the metal reinforcing members.

11. A moisture-controlling membrane construction for disposition between a wear course and a concrete substrate of a pavement wherein the substrate embodies metal reinforcing members comprising a layer of asphalt, a body of electrically conducting material associated with the layer of asphalt, the body of current conducting material comprising an open mesh fabric of metal wires, each wire bearing a coating of glass, an adhesive bonding the layer of asphalt to the substrate, and a source of electric energy connected with the body of current conducting material and the metal members whereby to draw chloride ions of salt water which may filter into the substrate away from the metal reinforcing members.

* * * * *

UNITED STATES PATENT AND TRADEMARK OFFICE

CERTIFICATE OF CORRECTION

PATENT NO. : 4,319,854

DATED : March 16, 1982

INVENTOR(S) : Alfred Marzocchi

It is certified that error appears in the above—identified patent and that said Letters Patent is hereby corrected as shown below:

In column 3, line 5, "cost" should read "coat".

Signed and Sealed this

Third Day of May 1983

[SEAL]

*Attest:*

GERALD J. MOSSINGHOFF

*Attesting Officer*

*Commissioner of Patents and Trademarks*